US006295896B1

(12) United States Patent
I-He

(10) Patent No.: US 6,295,896 B1
(45) Date of Patent: Oct. 2, 2001

(54) SOCKET WRENCH HAVING TWO ENGAGING RODS

(76) Inventor: Liao I-He, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/606,363

(22) Filed: Jun. 29, 2000

(51) Int. Cl.[7] ..... B25B 13/46
(52) U.S. Cl. ..... 81/63; 81/177.85
(58) Field of Search ..... 81/61–63.2, 177.85

(56) References Cited

U.S. PATENT DOCUMENTS 5,761,973 * 6/1998 Tung ..... 81/63.2
6,053,077 * 4/2000 Huang ..... 81/63.1

* cited by examiner

*Primary Examiner*—D. S. Meislin
(74) *Attorney, Agent, or Firm*—Charles E. Baxley

(57) ABSTRACT

A socket wrench includes a head with two engaging rods respectively extending from two sides of the head. Each engaging rod has a disk connected thereto and a spring is connected between the two disks. A release pin extends through the two engaging rods and has two notches for respectively receiving two balls embedded in the two engaging rods. A pawl member is pivotally received in the head and engaged with either one of the two disks. The two engaging rods are connected to two sockets with different sizes.

8 Claims, 4 Drawing Sheets

SOCKET WRENCH HAVING TWO ENGAGING RODS

FIELD OF THE INVENTION

The present invention relates to a socket wrench having two engaging rods which extend from two opposite sides of the head of the wrench and a release pin extending through the two engaging rods so that the wrench employs two sets of sockets with different sizes.

BACKGROUND OF THE INVENTION

A conventional socket wrench generally includes a head connected to a handle and an engaging rod extends from a side of the head. The engaging rod has a ball embedded in a side thereof so that a socket is securely connected to the engaging rod. A release pin is movably inserted into the engaging rod and has a notch in an outside thereof so that when pushing the release pin to a release position, the ball is received in the notch in the release pin and the force urging the socket disappears so that the socket can be removed from the engaging rod. By operating the release pin, the user may put different sockets on the engaging rod. The engaging rod may have a toothed outer periphery which is engaged with a pawl member in the head of the wrench so that the wrench becomes a ratchet tool. Each socket has an engaging hole for receiving the engaging rod and the size of the engaging hole has many sizes. Therefore, the socket wrench has a fixed engaging rod which can only be cooperated with the sockets having the engaging hole with a fixed size.

The present invention intends to provide a socket wrench that has two engaging rods and a release pin extends through the two engaging rods so that two sets of sockets can be used on the socket wrench.

SUMMARY OF THE INVENTION

In accordance with one aspect of the present invention, there is provided a wrench socket and comprising a head and a chamber defined in the head. A first engaging rod and a second engaging rod respectively extend through two sides of the head. A first toothed disk is connected to the first engaging rod and a second toothed disk is connected to the second engaging rod. A spring is connected between the first toothed disk and the second toothed disk. A pawl member is pivotally received in the chamber and engaged with the first toothed disk and the second toothed disk. A first ball is movably engaged with a side of the first engaging rod and a second ball is movably engaged with a side of the second engaging rod. A release pin movably inserted through the first engaging rod and the second engaging rod. The release pin has a first notch and a second notch for respectively receiving the first ball and the second ball.

The primary object of the present invention is to provide a socket wrench that can employ two different sets of sockets on two engaging rods respectively extending from two sides of the head of the wrench.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
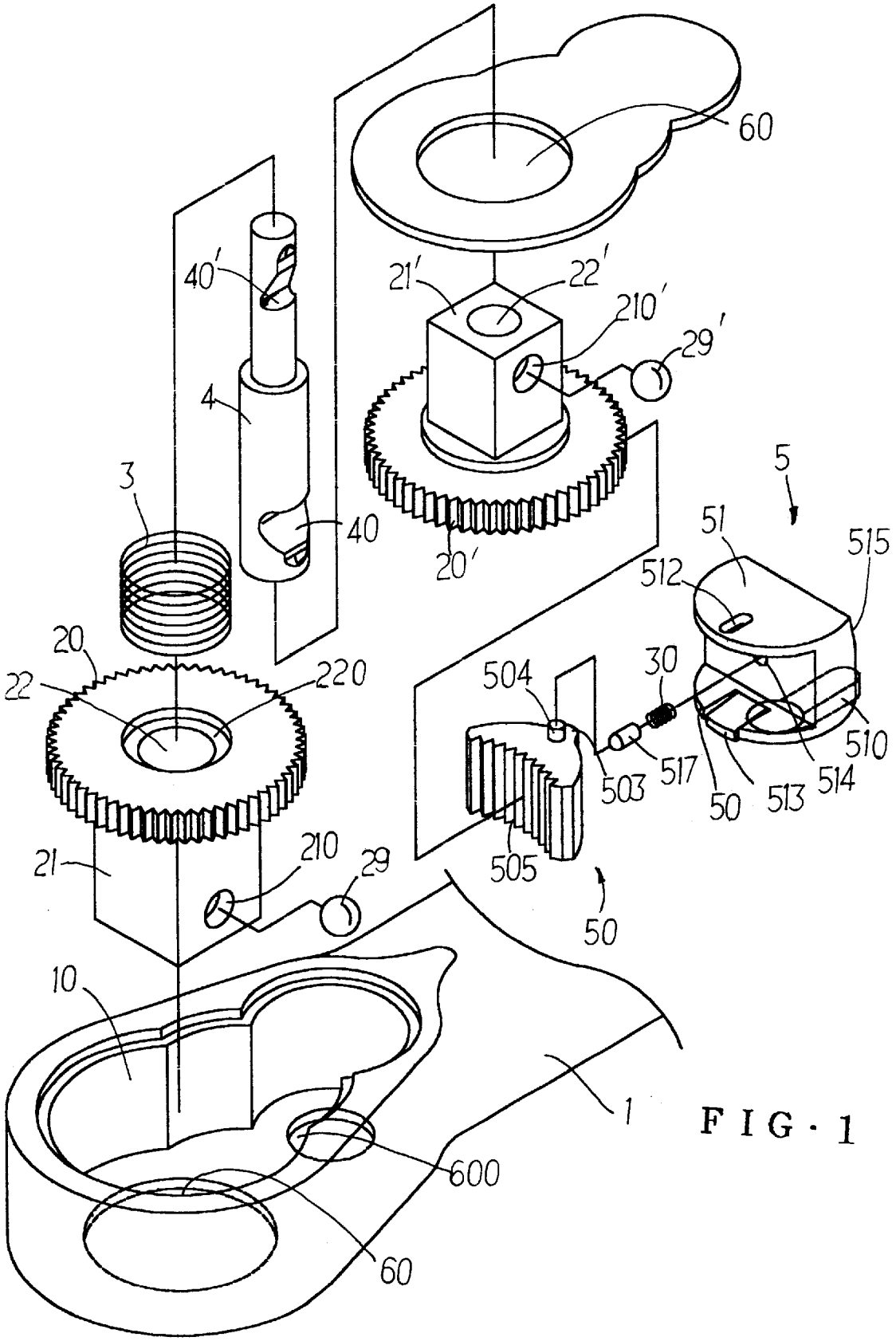
FIG. 1 is a perspective view to show a socket wrench of the present invention.
Figure 2:
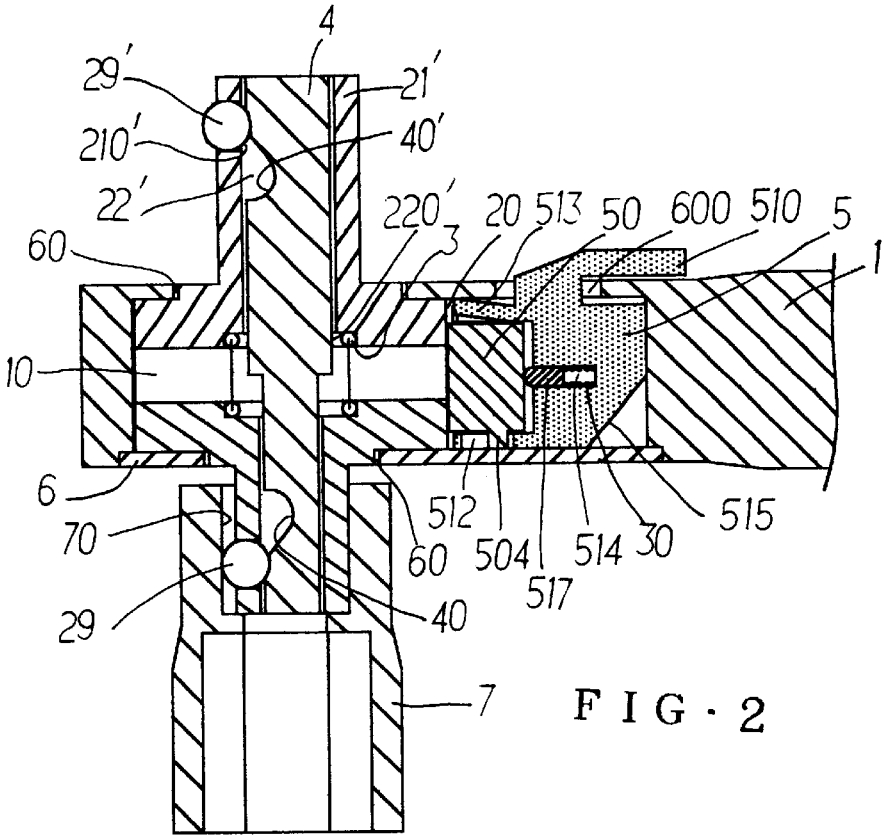
FIG. 2 is a cross-sectional view to show the socket wrench of the present invention.

Referring to FIGS. 1 and 2, the socket wrench of the present invention comprises a head 100 connected to a handle 1 and a chamber 10 is defined in the head 100. Two plates 6 are respectively connected to two sides of the head 100 and close the chamber 10. Each plate 6 has a first hole 60 defined therethrough and one of the two plates 6 further has a second hole 600. A first engaging rod 21 and a second engaging rod 21' respectively extend through the two first holes 60 in the two plates 6. The first engaging rod 21 has a hole 210 defined through a side thereof for movably receiving a first ball 29 therein, and a hole 210' is defined through a side of the second engaging rod 21' for movably receiving a second ball 29' therein. A first toothed disk 20 is connected to the first engaging rod 21 and a second toothed disk 20' is connected to the second engaging rod 21'. The first toothed disk 20 has a first recess 220 defined in an side opposite to the first engaging rod 21 and the second toothed disk 20' has a second recess 220' defined in an side opposite to the second engaging rod 21'. A spring 3 is engaged between the first recess 220 and the second recess 220'. A first passage 22 is defined through the first engaging rod 21 and the first toothed disk 20, and a second passage 22' is defined through the second engaging rod 21' and the second toothed disk 20'. A release pin 4 is movably inserted in the first passage 22 and the second passage 22'. The release pin 4 has a first notch 40 and a second notch 40' for respectively receiving the first ball 29 and the second ball 29'.

A frame 5 is pivotally received in the chamber 10 and has a first flange 51 and a second flange 50 extending in parallel therefrom. The first flange 51 has a slot 512 and the second flange 50 has a split plate 513. An aperture 514 is defined in the frame 5 and located between the first flange 51 and the second flange 50. A tubular member 517 is received in the aperture 514 and biased by a spring 30 in the aperture 514. A lever 510 is connected to the frame 5 and the lever 510 extends through the second hole 600 in the plate 6. The split plate 513 urges against a bottom side of the plate 6 as shown and an inclined surface 515 is defined in an end so as to conveniently install the frame 5 in the chamber 10. A pawl member 50 is pivotally received between the first flange 51 and the second flange 50. The pawl member 50 has a protrusion 504 on a side thereof and the protrusion 504 is movably received in the slot 512 in the first flange 51. A ridge 503 extends from an end of the pawl member 50 and the tubular member 517 is engaged with a side of the ridge 503. The pawl member 50 has a curved toothed surface 505 which is engaged with the first toothed disk 20 and the second toothed disk 20'.

Figure 3:
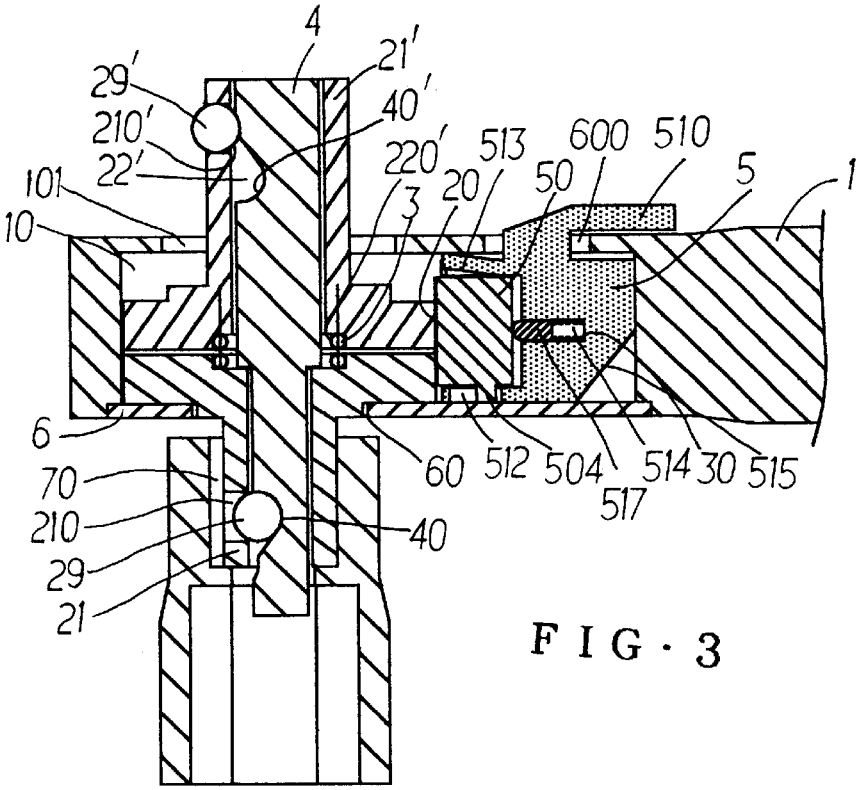
FIG. 3 is a cross-sectional view to show a ball in the lower engaging rod is received in a notch of a release pin when pushing an upper engaging rod.
Figure 4:
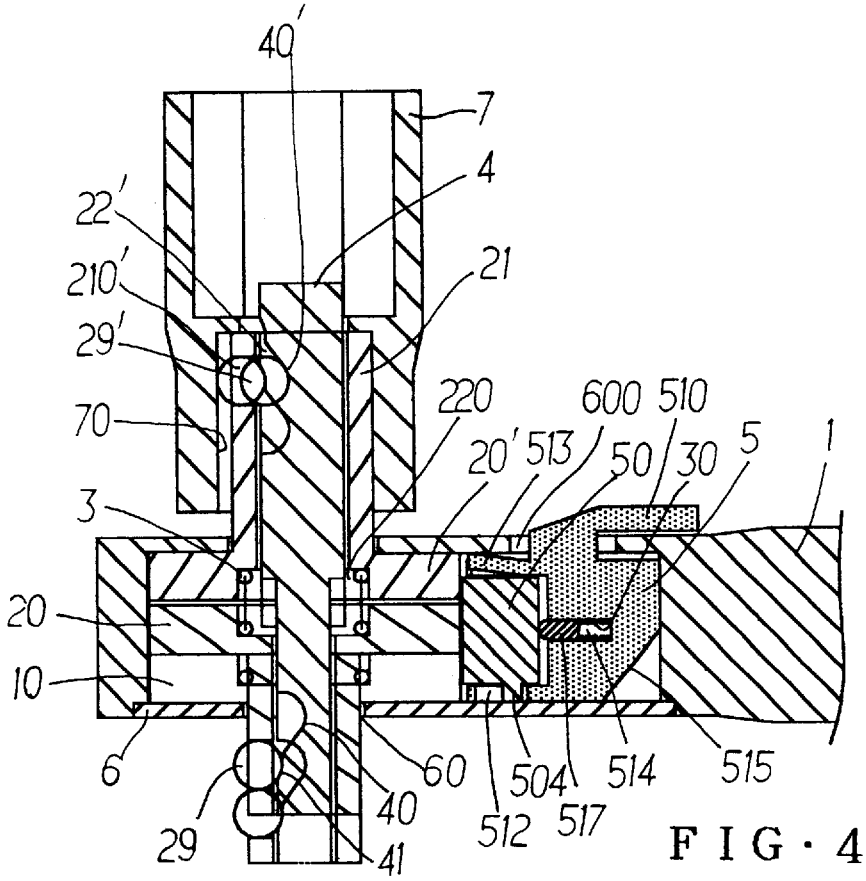
FIG. 4 is a cross-sectional view to show a ball in the upper engaging rod is received in the other notch of the release pin when pushing the lower engaging rod.

A socket 7 is mounted to the first engaging rod 21 and is securely positioned by the first ball 29 urging the socket 7 and the first ball 29 is pushed by the release pin 4. As shown in FIG. 3, when a user pushes the second engaging rod 21' toward the first engaging rod 21, the second engaging rod 21' and the pin 4 are lowered as shown in the FIG. 3 and the first notch 40 is lowered to received the first ball 29 so that the socket 7 can be removed from the first engaging rod 21. As shown in FIG. 4, a socket 7 mounted to the second engaging rod 21' can also be separated from the second engaging rod 21' by pushing the first engaging rod 21 and the release pin 4.

Figure 5:
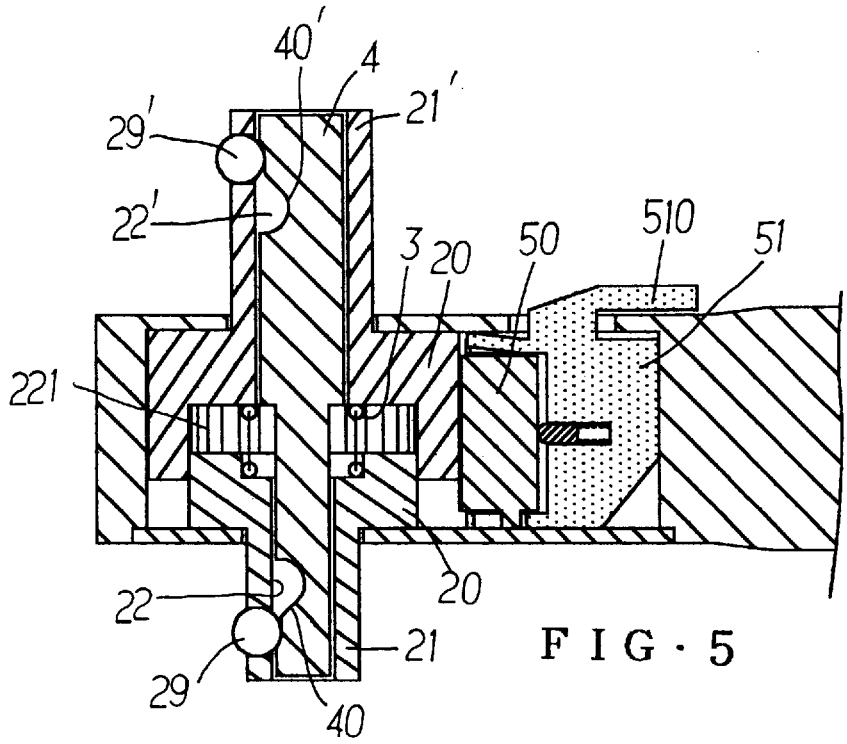
FIG. 5 is a cross-sectional view to show another embodiment of the socket wrench of the present invention.

FIG. 5 shows another embodiment of the socket wrench wherein the structure of the embodiment is the same as disclosure in FIGS. 1–4 except that the two disks respectively connected to the first engaging rod 21 and the second engaging rod 21' are different from those shown in FIGS. 1–4. The first disk 20 is connected to the first engaging rod 21 and the second disk 20' is connected to the second engaging rod 21' wherein the second disk 20' has a toothed outer periphery which is engaged with the pawl member 50. A spring 3 is connected between the first disk 20 and the second disk 20'. A recess 221 is defined in a side of the second disk 20' and located opposite to the second engaging rod 21'. The recess 221 in the second disk 20' has a toothed inner periphery. The first disk 20 has a toothed outer periphery which is engaged with the toothed inner periphery of the second disk 20'. A release pin 4 movably extends through a first passage 22 in the first engaging rod 21 and a second passage 22' in the second engaging rod 21'. The release pin 4 also has a first notch 40 and a second notch 40' for respectively receiving the first ball 29 and the second ball 29'.

Figure 6:
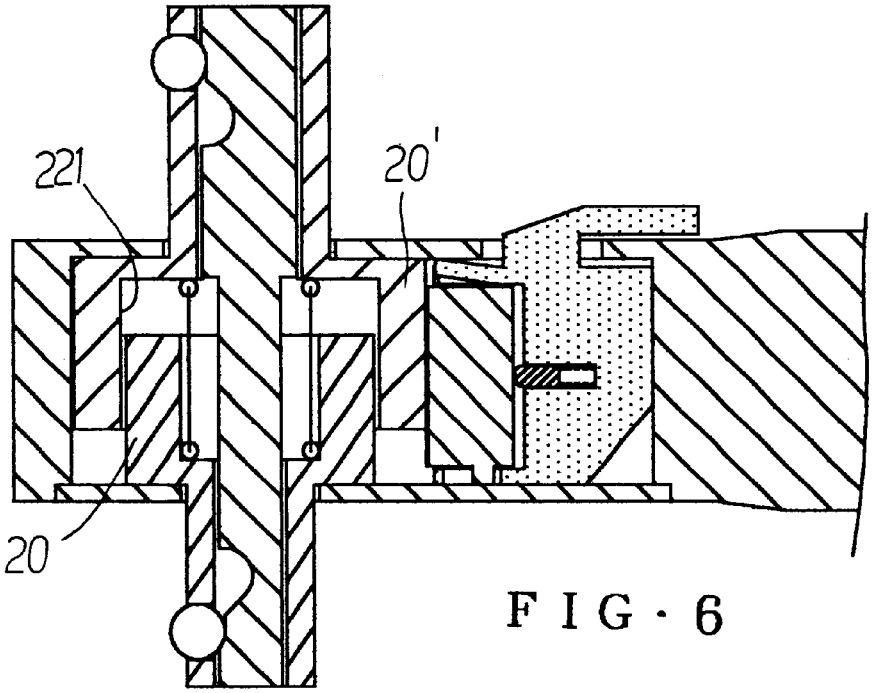
FIG. 6 is a cross-sectional view to show yet another embodiment of the socket wrench of the present invention.

FIG. 6 shows yet another embodiment of the engagement of the first disk 20 and the second disk 20'. The first disk 20 has a polygonal outer periphery and the recess 221 in the second disk 20' has a polygonal inner periphery which is engaged with the polygonal outer periphery of the first disk 20.

Figure 7:
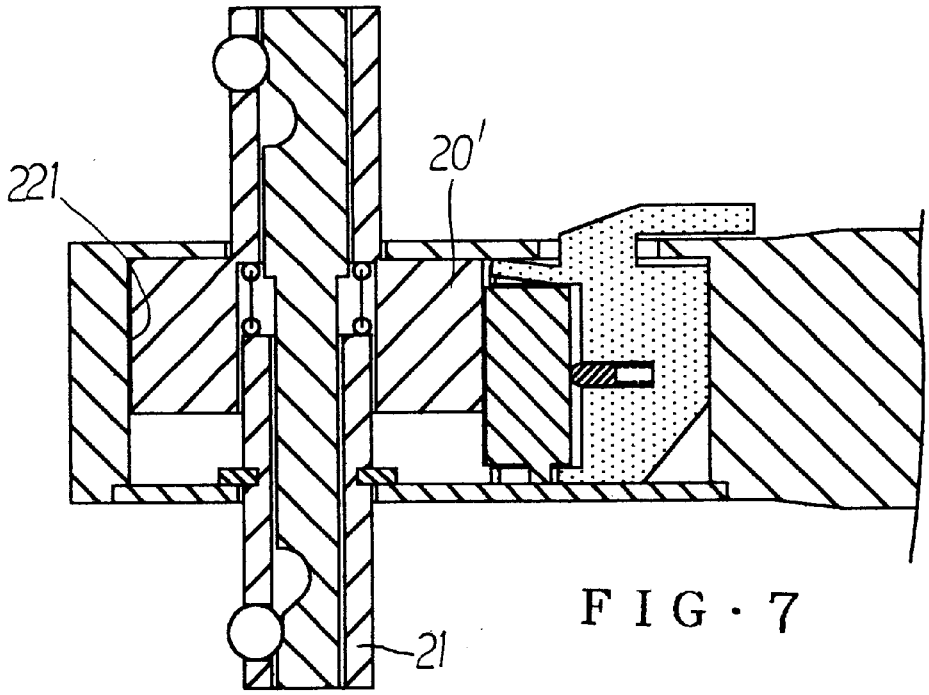
FIG. 7 is a cross-sectional view to show a further embodiment of the socket wrench of the present invention.

FIG. 7 shows a further embodiment of the engagement of the first engaging rod 21 and the second disk 20'. There is no first disk and an end of the first engaging rod 21 has a polygonal cross section which is engaged with the polygonal inner periphery defined in the recess 221 in the second disk 20'.

While we have shown and described various embodiments in accordance with the present invention, it should be clear to those skilled in the art that further embodiments may be made without departing from the scope and spirit of the present invention.

What is claimed is:

1. A wrench socket comprising:

a head connected to a handle and a chamber defined in said head, two plates respectively connected to two sides of said head and closing said chamber, each plate having a first hole defined therethrough, a first engaging rod and a second engaging rod respectively extending through said two first holes in said two plates, a first toothed disk connected to said first engaging rod and a second toothed disk connected to said second engaging rod, a spring connected between said first toothed disk and said second toothed disk, a pawl member pivotally received in said chamber and engaged with said first toothed disk and said second toothed disk, a first passage defined through said first engaging rod and said first toothed disk, a second passage defined through said second engaging rod and said second toothed disk, a first ball movably engaged with a side of said first engaging rod and a second ball movably engaged with a side of said second engaging rod, and a release pin movably inserted in said first passage and said second passage, said release pin having a first notch and a second notch for respectively receiving said first ball and said second ball.

2. The socket wrench as claimed in claim 1, wherein said first toothed disk has a first recess defined in an side opposite to said first engaging rod and said second toothed disk has a second recess defined in an side opposite to said second engaging rod, said spring engaged between said first recess and said second recess.

3. The socket wrench as claimed in claim 1 further comprising a frame pivotally received in said chamber and having a first flange and a second flange extending therefrom, said first flange having a slot and said second flange having a split plate, an aperture defined in said frame and located between said first flange and said second flange, a tubular member received in said aperture and biased by a spring in said aperture, said pawl member having a protrusion on a side thereof and said protrusion movably received in said slot in said first flange, a ridge extending from an end of said pawl member and said tubular member engaged with a side of said ridge.

4. The socket wrench as claimed in claim 3 further comprising a lever connected to said frame and one of said two plates having a second hole through which said lever extends.

5. A socket wrench comprising:

a head connected to a handle and a chamber defined in said head, two plates respectively connected to two sides of said head and closing said chamber, each plate having a first hole defined therethrough, a first engaging rod and a second engaging rod respectively extending through said two first holes in said two plates, a first disk connected to said first engaging rod and a second disk connected to said second engaging rod, a spring connected between said first disk and said second disk, said second disk having a toothed outer periphery, a frame pivotally received in said chamber and having a first flange and a second flange extending therefrom, said first flange having a slot and said second flange having a split plate, an aperture defined in said frame and located between said first flange and said second flange, a tubular member received in said aperture and biased by a spring in said aperture, a pawl member pivotally received in said chamber and engaged with said toothed outer periphery of said second disk, said pawl member having a protrusion on a side thereof and said protrusion movably received in said slot in said first flange, a ridge extending from an end of said pawl member and said tubular member engaged with a side of said ridge, a recess defined in a side of said second disk and located opposite to said second engaging rod, said first disk securely engaged with said recess in said second disk, a first passage defined through said first engaging rod and said first disk, a second passage defined through said second engaging rod and said second disk, a first ball movably engaged with a side of said first engaging rod and a second ball movably engaged with a side of said second engaging rod, and a release pin movably inserted in said first passage and said second passage, said release pin having a first notch and a second notch for respectively receiving said first ball and said second ball.

6. The socket wrench as claimed in claim 5 wherein said first disk has a toothed outer periphery and said recess in said second disk has a toothed inner periphery which is engaged with said toothed outer periphery of said first disk.

7. The socket wrench as claimed in claim 5 wherein said first disk has a polygonal outer periphery and said recess in said second disk has a polygonal inner periphery which is engaged with said polygonal outer periphery of said first disk.

8. The socket wrench as claimed in claim 5 further comprising a lever connected to said frame and one of said two plates having a second hole through which said lever extends.

* * * * *